US010046928B2

(12) United States Patent
Yazawa et al.

(10) Patent No.: US 10,046,928 B2
(45) Date of Patent: Aug. 14, 2018

(54) TRANSPORT APPARATUS

(71) Applicant: FUJI XEROX CO., LTD., Tokyo (JP)

(72) Inventors: Takayuki Yazawa, Kanagawa (JP); Takashi Abe, Kanagawa (JP); Shouichi Maeda, Kanagawa (JP); Junichi Asaoka, Kanagawa (JP); Shinji Yaginuma, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/469,019

(22) Filed: Mar. 24, 2017

(65) Prior Publication Data

US 2018/0024488 A1 Jan. 25, 2018

(30) Foreign Application Priority Data

Jul. 21, 2016 (JP) ..... 2016-142955

(51) Int. Cl.
*B65H 1/04* (2006.01)
*B65H 1/08* (2006.01)

(52) U.S. Cl.
CPC ..... *B65H 1/08* (2013.01); *B65H 1/04* (2013.01); *B65H 2401/115* (2013.01)

(58) Field of Classification Search
CPC ..... B65H 1/14; B65H 2405/32; B65H 2405/324; B65H 2405/35; B65H 2405/353
USPC ..... 271/147, 157
See application file for complete search history.

(56) References Cited

U.S. PATENT DOCUMENTS 1,022,776 A * 4/1912 Dexter et al. ..... B65H 1/14 271/157
2,334,223 A * 11/1943 Smith ..... B65H 1/14 271/162
3,995,952 A * 12/1976 Schoppe ..... B65H 1/14 271/122
4,535,982 A * 8/1985 Mochimaru ..... B65H 1/266 271/127
4,900,004 A * 2/1990 Ushirogata ..... B65H 1/14 271/121
5,794,928 A * 8/1998 Araseki ..... B65H 1/04 271/126
5,971,387 A * 10/1999 Kita ..... B65H 1/26 271/147
2008/0079216 A1* 4/2008 Fuchi ..... B65H 1/04 271/160

(Continued)

FOREIGN PATENT DOCUMENTS

JP 2015-199556 A 11/2015

*Primary Examiner* — David H Bollinger
(74) *Attorney, Agent, or Firm* — Sughrue Mion, PLLC

(57) ABSTRACT

A transport apparatus includes
an accommodating unit that accommodates a recording medium and that is mounted to be capable of reciprocating with respect to a body portion,
a loading plate that is provided in the accommodating unit to be movable up and down and that is loaded with the recording medium,
a lifting unit that
moves up the loading plate to a position where the recording medium is able to be fed by winding wires connected to opposite end portions of the loading plate to suspend the loading plate, and
moves down the loading plate by feeding the wires, and
a receiving member that is provided on a bottom surface of the accommodating unit and that receives abutments provided on the loading plate when the loading plate moves down.

18 Claims, 8 Drawing Sheets

(56) References Cited

U.S. PATENT DOCUMENTS

| | | | | |
|---|---|---|---|---|
| 2010/0038845 | A1* | 2/2010 | Baena, Jr. ..... | B65H 1/14<br>271/160 |
| 2010/0133745 | A1* | 6/2010 | Ikeuchi ..... | B65H 1/14<br>271/265.04 |
| 2011/0024970 | A1* | 2/2011 | Uchida ..... | B65H 1/14<br>271/10.16 |
| 2015/0284195 | A1 | 10/2015 | Kushida et al. | |

* cited by examiner

TRANSPORT APPARATUS

CROSS-REFERENCE TO RELATED APPLICATIONS

This application is based on and claims priority under 35 USC 119 from Japanese Patent Application No. 2016-142955 filed Jul. 21, 2016.

BACKGROUND

Technical Field

The present invention relates to a transport apparatus.

SUMMARY

According to an aspect of the invention, a transport apparatus includes an accommodating unit that accommodates a recording medium and is mounted to be capable of reciprocating with respect to a body portion, a loading plate that is provided in the accommodating unit to be movable up and down and that is loaded with the recording medium, a lifting unit that moves up the loading plate to a position where the recording medium is able to be fed by winding wires connected to opposite end portions of the loading plate to suspend the loading plate, and moves down the loading plate by feeding the wires, and a receiving member that is provided on a bottom surface of the accommodating unit and that receives abutments provided on the loading plate when the loading plate moves down.

BRIEF DESCRIPTION OF THE DRAWINGS

Exemplary embodiments of the present invention will be described in detail based on the following figures, wherein.

DETAILED DESCRIPTION

Figure 1:
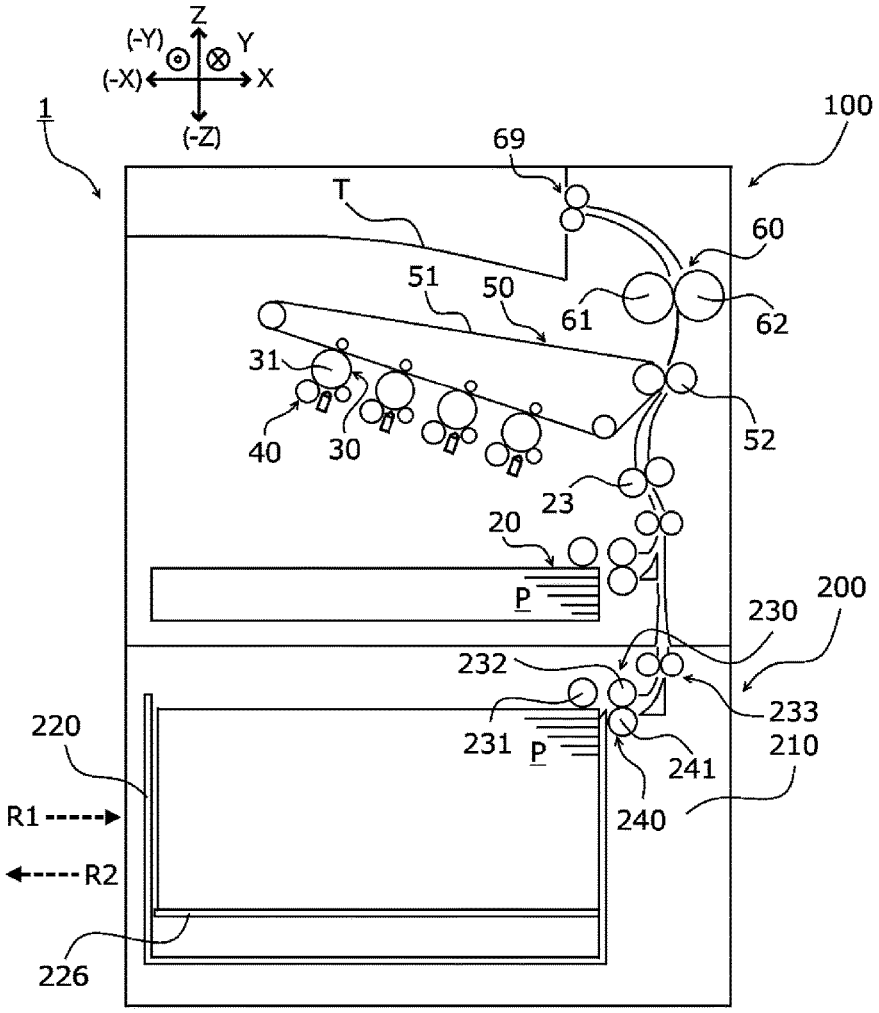
FIG. 1 is a cross-sectional view schematically illustrating an internal configuration of an image forming system.

Next, exemplary embodiments and specific examples of the present invention will be described in more detail below with reference to the accompanying drawings, but the present invention is not limited thereto.

In addition, it shall be noted that the drawings are schematic ones and respective ratios of dimensions or the like are different from practical ones. For easy understanding, illustrations of components other than those necessary for description will be properly omitted.

In order to facilitate the understanding of the following description, a front and rear direction in the drawings will be referred to as an "X-axis direction," a left and right direction in the drawings will be referred to as a "Y-axis direction," and an up and down direction in the drawings will be referred to as a "Z-axis direction."

(1) Entire Configuration and Operation of Image Forming System

FIG. 1 is a cross-sectional view schematically illustrating an internal configuration of an image forming system 1 to which a transport apparatus 200 according to an exemplary embodiment is applied. The image forming system 1 illustrated in FIG. 1 includes an image forming apparatus 100, such as a printer or a copier, which forms an image by an electrophotographic system, and a transport apparatus 200 that transports sheets P as recording media on which toner images are formed in the image forming apparatus 100.

Hereinafter, the entire configuration and operation of the image forming system 1 will be described with reference to the drawings.

(1.1) Entire Configuration and Operation of Image Forming Apparatus

The image forming apparatus 100 includes a controller 10, a sheet feeding device 20, photoconductor units 30, developing devices 40, a transfer device 50, and a fixing device 60. The transport apparatus 200 is disposed below the image forming apparatus 100 (in the minus (−) Z direction), and the sheets P on which an image has been formed are transported to the image forming apparatus 100.

The sheet feeding device 20 loaded with sheets P as recording media is installed in the bottom portion of the image forming apparatus 100. The sheets P positioned in the width direction by a regulation plate (not illustrated) are drawn out forward (in the minus (−) X direction) one by one from the top side by a sheet drawing part 22, and are then transported to a nip portion of a registration roller pair 23.

The photoconductor units 30 include respective photoconductor drums 31 that are installed in parallel with each other above the sheet feeding device 20 (in the Z direction) to be rotationally driven. The toner images of yellow (Y), magenta (M), cyan (C), and black (K) are formed on the respective photoconductor drums 31 by the respective developing devices 40.

Respective color toner images formed on the photoconductor drums 31 of the respective photoconductor units 30 are sequentially and electrostatically transferred (primarily transferred) onto an intermediate transfer belt 51 of the transfer device 50, thereby forming superimposed toner images in which the respective color toners are superimposed. The superimposed toner images on the intermediate transfer belt 51 are delivered from the registration roller pair 23, and batch-transferred, by a secondary transfer roller 52, onto a sheet P that is guided by a transport guide.

The sheet P, to which the toner images have been batch-transferred in the transfer device 50, is transported to the fixing device 60 in a state in which the toner images are not fixed, and the toner images are fixed by the heating and pressing actions of a pair of heating module 61 and pressure module 62.

The sheet P, on which the fixed toner images have been formed, is guided by the transport guide and discharged from a discharge roller pair 69 to be accommodated in a discharge tray T formed on the upper surface of the image forming apparatus 100 (in the Z direction).

(1.2) Entire Configuration and Operation of Transport Apparatus

The transport apparatus 200 includes a body portion 210 and an accommodating unit 220. The body portion 210 is configured to be detachably mounted to the image forming apparatus 100, and has a transport path of sheets P, which is connected to a sheet transport path provided in the image forming apparatus 100.

The accommodating unit 220 is configured to accommodate plural sheets P therein and reciprocate to be mounted to the body portion 210. The accommodating unit 220 includes a bottom plate 226 as a loading plate on which the sheets P accommodated in the accommodating unit 220 are loaded, and the accommodating unit 220 moves up and down the bottom plate 226 depending on the remaining amount of the sheets P.

The accommodating unit 220 is mounted by moving in the direction of arrow R1 in FIG. 1, and is demounted (i.e., released from the mounted state) by moving in the direction of arrow R2 such that the replenishment of sheets P is performed.

A sheet feeding unit 230 is installed to the body portion 210, and a supply unit 240 is attached to the accommodating unit 220. In the state in which the accommodating unit 220 is mounted to the body portion 210, a feed roller 232 of the sheet feeding unit 230 and a retard roller 241 of the supply unit 240 are abutted against each other such that the sheets P sent from a nudger roller 231 are separated one by one and transported to the image forming apparatus 100.

(2) Transport Apparatus

Figure 2A:
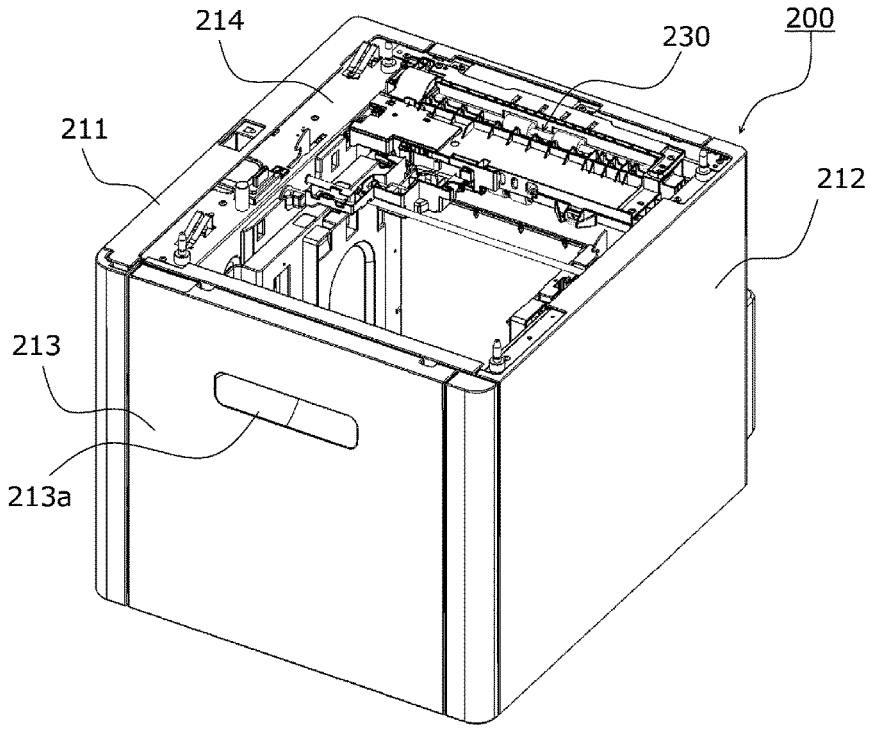
FIG. 2A is a perspective view illustrating an entire transport apparatus.
Figure 2B:
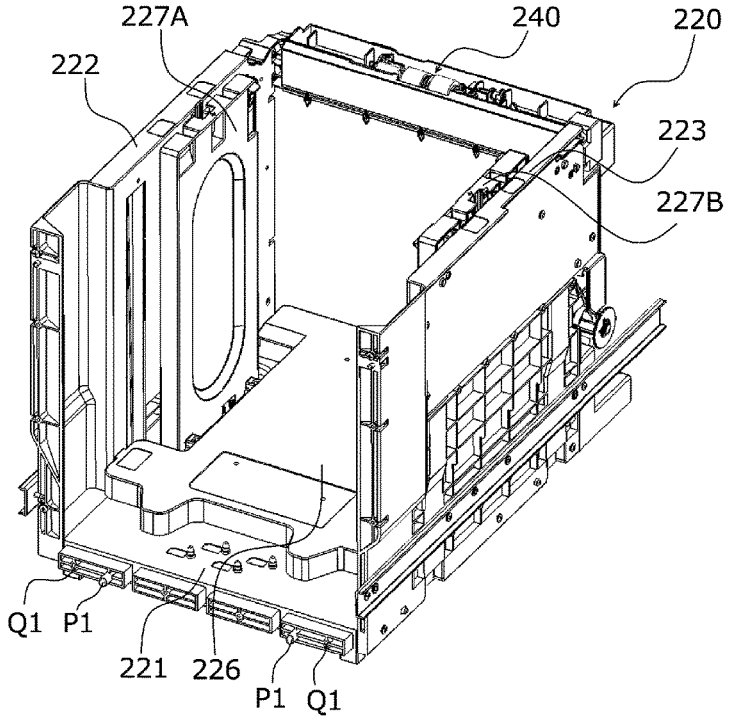
FIG. 2B is a perspective view illustrating an accommodating unit, excluding a front frame.
Figure 3:
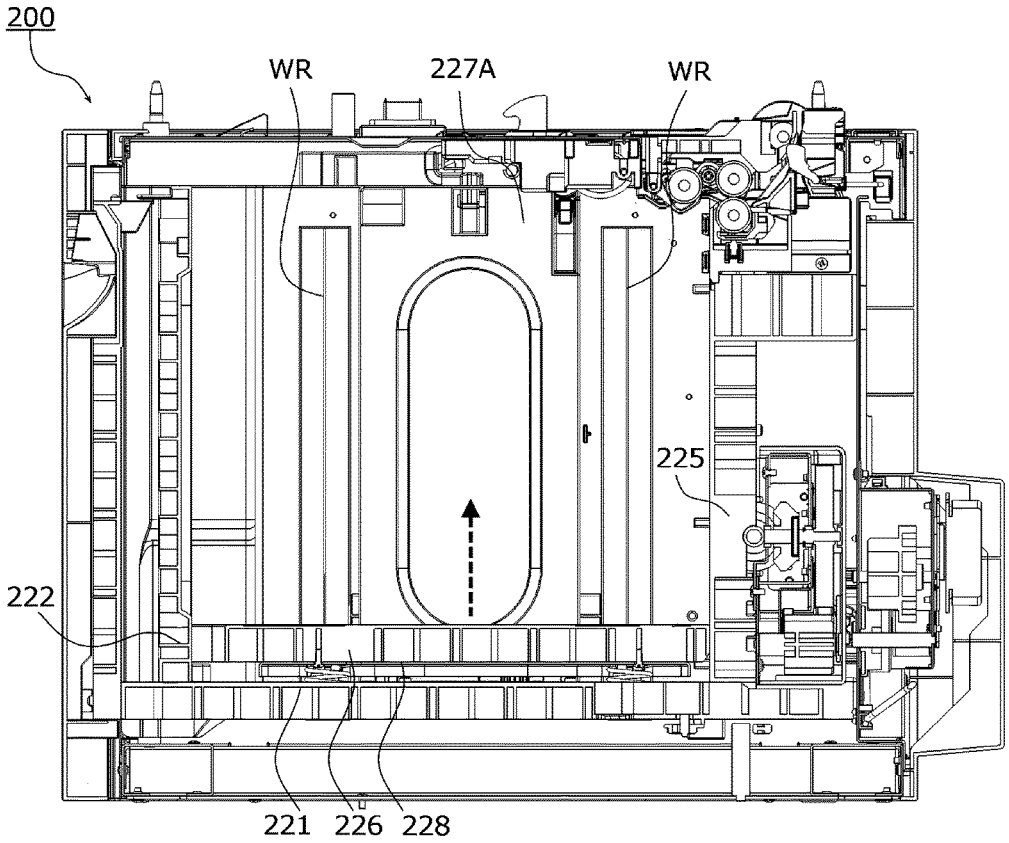
FIG. 3 is a longitudinal cross-sectional view of the transport apparatus.
Figure 4:
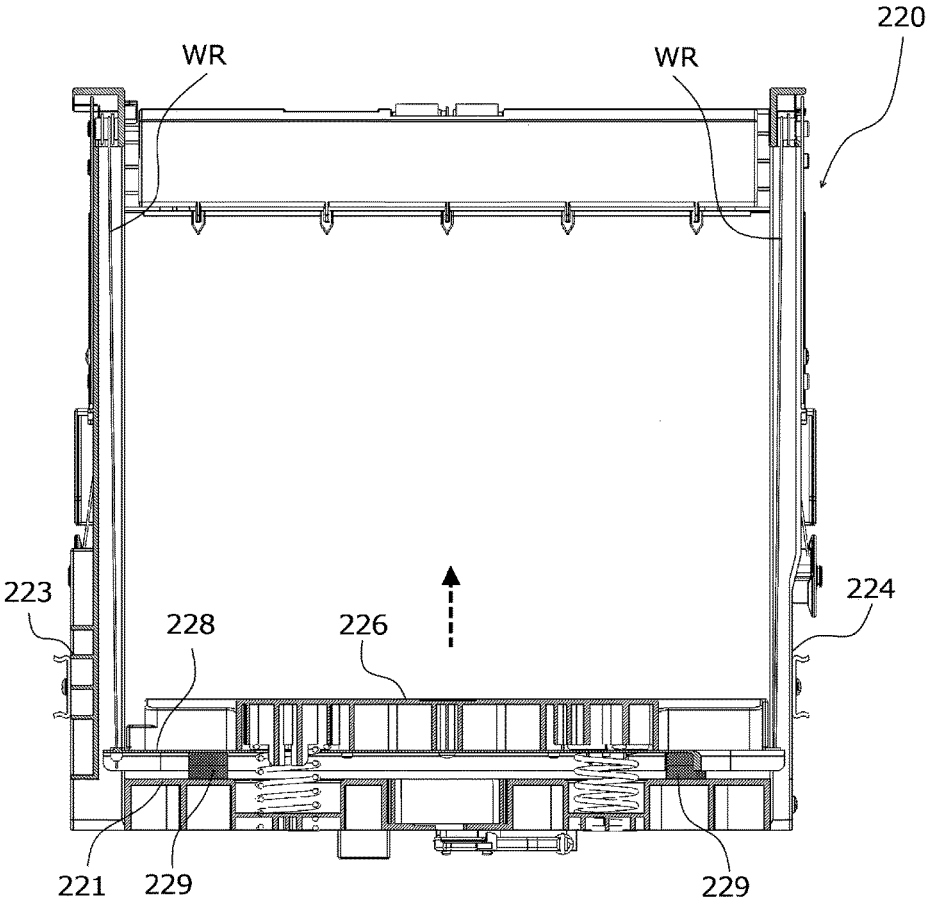
FIG. 4 is a transversal cross-sectional view of the accommodating unit.
Figure 5A:
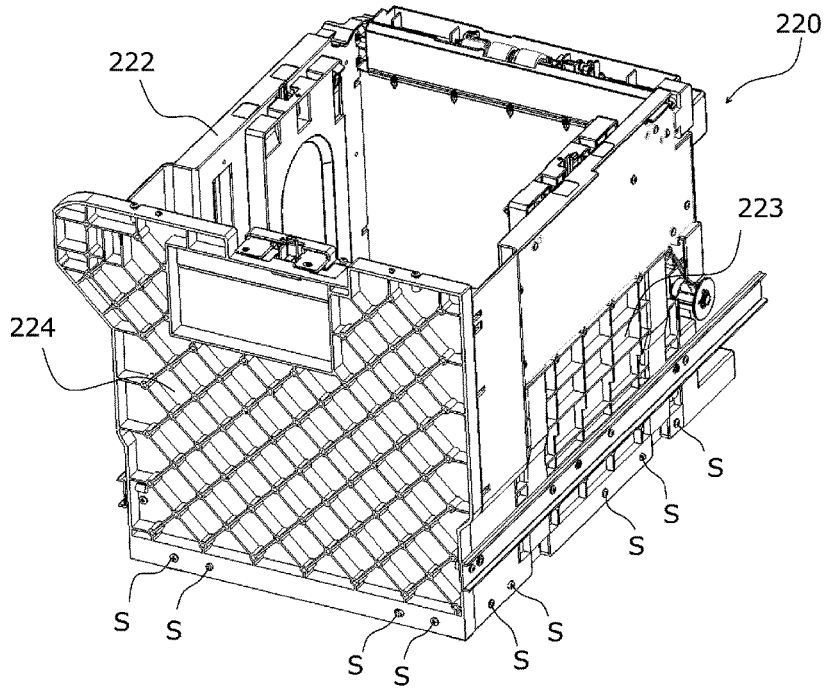
FIG. 5A is a perspective view of the accommodating unit when viewed from a sheet storage side.
Figure 5B:
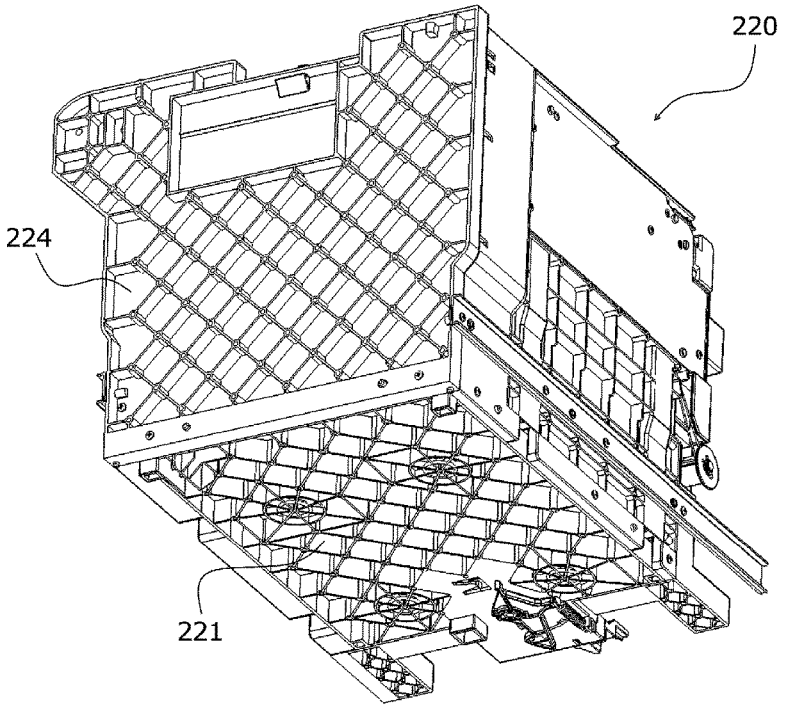
FIG. 5B is a perspective view of the accommodating unit when viewed from a bottom frame side.
Figure 6:
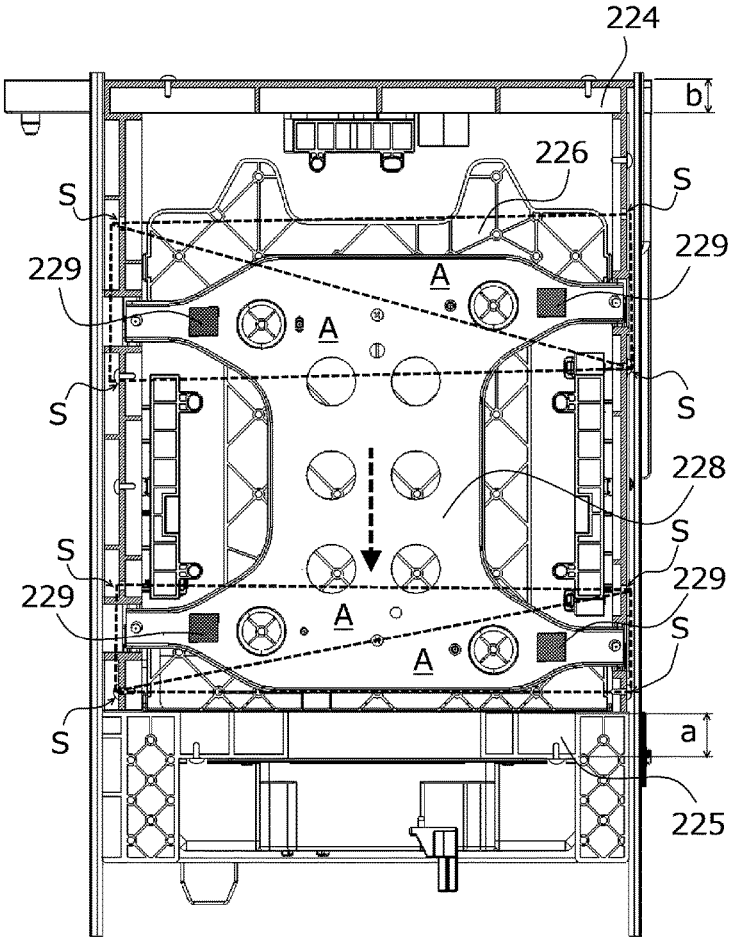
FIG. 6 is a bottom view illustrating a positional relationship between fastening points in the accommodating unit and elastic members without illustrating the bottom frame.
Figure 7:
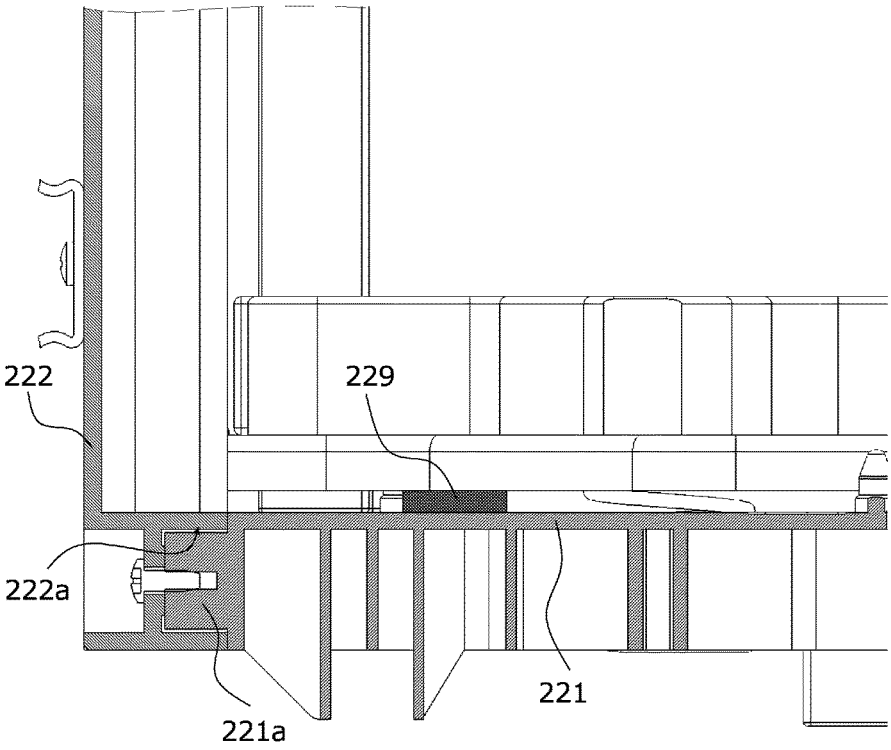
FIG. 7 is a cross-sectional view schematically illustrating a fastening structure between a bottom frame and a left side frame.

FIG. 2A is a perspective view illustrating the entire transport apparatus 200, and FIG. 2B is a perspective view illustrating the accommodating unit 220, excluding a front frame 224. FIG. 3 is a longitudinal cross-sectional view of the transport apparatus 200. FIG. 4 is a transversal cross-sectional view of the accommodating unit 220. FIG. 5A is a perspective view of the accommodating unit 220 when viewed from the sheet storage side, and FIG. 5B is a perspective view of the accommodating unit 220 when viewed from the bottom frame 221 side. FIG. 6 is a bottom view illustrating a positional relationship between fastening points S in the accommodating unit 220 and elastic members 229 without illustrating the bottom frame 221. FIG. 7 is a cross-sectional view schematically illustrating a fastening structure between a bottom frame 221 and a left side frame 222.

Hereinafter, the configuration of the transport apparatus 200 and the structure of the accommodating unit 220 will be described with reference to the drawings.

(2.1) Entire Configuration

The transport apparatus 200 is configured with the body portion 210 and the accommodating unit 220 that is held in the body portion 210 to be capable of reciprocating.

As illustrated in FIG. 2A, the body portion 210 is provided with the sheet feeding unit 230 in a metal-made housing 214 that is covered by a left side cover 211, a right side cover 212, and a front cover 213 which are made of a synthetic resin.

As illustrated in FIG. 2B, the accommodating unit 220 is a tray that is made of a synthetic resin and generally has a box shape in which left and right side frames 222 and 223 as an example of opposite side walls, a front frame 224 (illustrated in FIGS. 5A and 5B), and a rear frame 225 (illustrated in FIG. 3) are erected on the respective edge portions of the bottom frame 221 as an example of a receiving member. The inside of the accommodating unit 220 is formed as a storage space that stores the sheets P.

In the inside of the accommodating unit 220, the bottom plate 226 on which the accommodated sheets P are loaded is installed on the bottom frame 221 to be substantially parallel with the bottom frame 221, and a pair of side guides 227A and 227B, which position the sheets P loaded on the bottom plate 226 in the width direction, are disposed to be spaced apart from each other.

As illustrated in FIGS. 3 and 4, the bottom plate 226 is supported to be movable up and down with respect to the left and right side frames 222 and 223 to be substantially parallel with the bottom frame 221, through a metal-made suspension plate 228 supported by suspension wires WR as an example of a wire (see arrows in FIGS. 3 and 4).

Elastic members 229 as an example of abutments are provided on the surface of the suspension plate 228, which faces the bottom frame 221. The elastic members 229 are anti-vibration rubbers that serve to absorb the impact force by an elastic deformation when the bottom plate 226 descends and thus the suspension plate 228 comes into contact with the bottom frame 221.

(2.2) Fastening Structure of Accommodating Unit

As illustrated in FIGS. 5A and 5B, the accommodating unit 220 generally has a box shape in which the left side frame 222, the right side frame 223, the front frame 224, and the rear frame 225 are screwed to the respective edge portions of the bottom frame 221 by screws as an example of fastening members.

Each of the bottom frame 221, the left side frame 222, the right side frame 223, the front frame 224, and the rear frame 225 is a plate member that is made of a synthetic resin and has a lattice-shape rib structure on an outer surface thereof, and is reduced in weight while maintaining the strength thereof.

Specifically, positioning bosses P1 and screw holes Q1 are formed in each of the edge portions of the bottom frame 221 as illustrated in FIG. 2B byway of an example. By fitting the bosses into positioning holes formed in the left side frame 222, the right side frame 223, the front frame 224, and the rear frame 225, the frames are positioned in relation to each other and fixedly screwed.

As a result, as illustrated in FIGS. 5A and 5B, the accommodating unit 220 has a plate frame structure in which the bottom frame 221 is fastened to the left side frame 222, the right side frame 223, the front frame 224, and the rear frame 225 at plural fastening points S.

FIG. 6 illustrates the positional relationship between the fastening points S in the accommodating unit 220 and the elastic members 229 installed to the suspension plate 228 without illustrating the bottom frame 221.

As illustrated in FIG. 6, the elastic members 229 are provided at four corners of the suspension plate 228 that supports the bottom plate 226.

The left side frame 222 and the right side frame 223 are fastened to the bottom frame 221 (not illustrated in FIG. 6) at plural fastening points S, and one elastic member 229 is provided within each triangle region A defined by connecting the plural fastening points S in a plan view.

Therefore, the bottom frame 221, which comes into contact with the elastic members 229 of the descending suspension plate 228, has a structure that is fastened at three fastening points in the vicinity of each of the elastic members 229, and as a result, the impact force of the descending bottom plate 226 is dispersed, so that the decrease in strength as a plate frame structure can be prevented.

As illustrated in FIG. 6, each of the elastic members 229 is disposed to be in contact with the bottom frame 221 at a position displaced to the downstream side in the feeding direction of sheets P (see the arrow in FIG. 6).

That is, each of the elastic members 229 is disposed at a position displaced to the rear frame 225 side where the retard roller 241 is held, with respect to the front and rear frames 224 and 225 erected on the sides intersecting (orthogonal to) the feeding direction of sheets P.

In addition, as illustrated in FIG. 6, the rear frame 225 is formed to have a thick thickness in a plate thickness direction as a plate member, compared to the front frame 224 (a>b in FIG. 6), thereby having a high rigidity.

Therefore, the decrease in strength as a plate frame structure that receives the impact force of the elastic members 229 is further prevented.

The bottom frame 221 is an example of a receiving member that receives the impact force of the elastic members 229. Projection portions of the bottom frame 221 which are formed in a plug-in shape are fitted to recess portions formed in the left and right side frames 222 and 223. The bottom frame 221 is fastened to the left and right side frames 222 and 223 through fastening members.

Specifically, as illustrated in FIG. 7 by way of an example, the bottom frame 221 has a projection portion 221*a* formed at an edge portion thereof, the left side frame 222 is formed with a recess portion 222*a* to be fitted to the projection portion 221*a*, and the projection portion 221*a* of the bottom frame 221 and the recess portion 222*a* of the left side frame 222 are screwed to each other in the state of being fitted to each other.

Therefore, since each of the fastening points S has a structure in which the impact force of the elastic member 229 is received by the recess portion 222*a* and the projection portion 221*a* formed in a plug-shape, the decrease in strength as a plate frame structure is prevented.

[Modification 1]

Figure 8A:
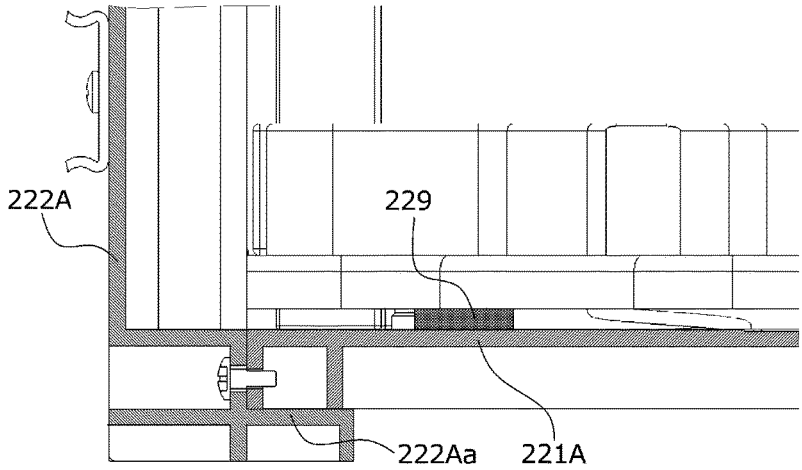
FIGS. 8A, 8B and 8C are cross-sectional views each schematically illustrating a fastening structure between a bottom frame and a left side frame according to modification examples.

FIG. 8A is a cross-sectional view schematically illustrating a fastening structure of a bottom frame 221A, a left side frame 222A, and a right side frame 223A (not illustrated) according to Modification 1.

The left side frame 222A is formed with a protrusion 222Aa that inwardly protrudes, and the bottom frame 221A is screwed in a state in which the opposite end portions of the bottom frame 221A are placed on the protrusion 222Aa of the left side frame 222A.

Therefore, since the fastening point S has a structure in which the impact force of the elastic member 229 is received by the bottom frame 221A placed on the protrusion 222Aa of the left side frame 222A, the decrease in strength as a simplified plate frame structure is prevented.

[Modification 2]

Figure 8B:
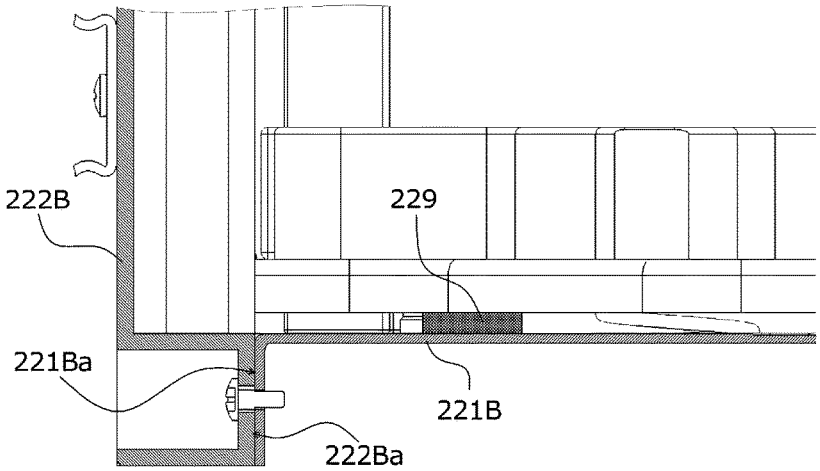

FIG. 8B is a cross-sectional view schematically illustrating a fastening structure of a bottom frame 221B, a left side frame 222B, and a right side frame 223B (not illustrated) according to Modification 2.

The bottom frame 221B is a metal-made plate member, and has a flat surface 221Ba formed by bending the opposite end portions thereof. The left side frame 222B is formed with an abutment surface 222Ba, and is screwed in a state in which the abutment surface 222Ba is abutted against the flat surface 221Ba of the bottom frame 221B.

Therefore, since the fastening point S has a structure in which the impact force of elastic members 229 is received by the metal bottom frame 221B shaped to be bent and abutted against the abutment surface 222Ba of the left side frame 222B, the decrease in strength as a more simplified plate frame structure is prevented.

[Modification 3]

Figure 8C:
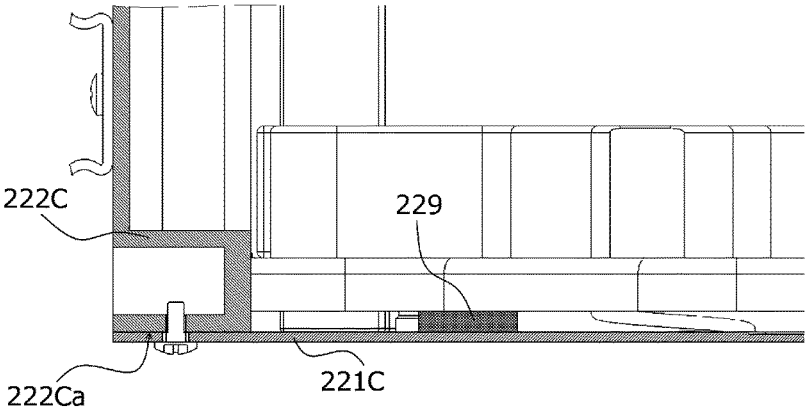

FIG. 8C is a cross-sectional view schematically illustrating a fastening structure of a bottom frame 221C, a left side frame 222C, and a right side frame 223C (not illustrated) according to Modification 3.

The bottom frame 221C is a metal-made flat plate member, and is directly screwed to the bottom surface 222Ca of the left side frame 222C.

Therefore, since each of the fastening points S has a structure of receiving the impact force of elastic members 229 in a fastening direction of fixing screws, the decrease in strength as a further simplified plate frame structure is prevented.

(2.3) Attachment and Detachment Operation of Accommodating Unit

When sheets P as recording media are replenished to the transport apparatus 200, the accommodating unit 220 is moved from the body portion 210 in the direction of arrow R2 (see FIG. 1) by operating a handle portion 213*a* (see FIG. 2A) of the front cover 213, so that a sheet bundle is loaded on the bottom plate 226 in a state in which the bottom plate 226 is exposed.

After the sheets P are loaded on the bottom plate 226, the accommodating unit 220 is moved in the direction of arrow R1 to be mounted in the body portion 210 by operating the handle portion 213*a* of the front cover 213.

The accommodating unit 220 is a tray that is made of a synthetic resin and has a plate frame structure in which the left side frame 222, the right side frame 223, the front frame 224, and the rear frame 225 are erected on the bottom frame 221. The accommodating unit 220 is reduced in weight as a whole, compared to a metal-made one.

Meanwhile, when the accommodating unit 220 is drawn out at the time of replenishing sheets P, the bottom plate 226 supported through the suspension plate 228 with the suspension wires WR moves down so that a large impact force acts on the bottom frame 221. As a result, there is a concern that the strength of the accommodating unit 220 as a plate frame structure is decreased since an excessive load is applied to the fastening points S of the bottom frame 221 and the left and right side frames 222 and 223.

In particular, when the accommodating unit 220 is drawn out in the state in which plural sheets P are loaded on the bottom plate 226, there is a concern that a large impact force acts on the bottom frame 221 due to the weight of the sheets P. As a result, excessive stresses are generated in the fastening points S so that the accommodating unit may be damaged.

The accommodating unit 220 according to the present exemplary embodiment is provided with the elastic members 229 as abutment members at four corners of the suspension plate 228 that supports the bottom plate 226, the left side frame 222 and the right side frame 223 are fastened to the bottom frame 221 at plural fastening points S, and one elastic member 229 is provided within each triangle region A defined by connecting the plural fastening points S in a plan view.

Therefore, the bottom frame 221, the left side frame 222, and the right side frame 223 are fastened to each other at three fastening points in the vicinity of each of the elastic members 229. As a result, the impact force of the descending bottom plate 226 is dispersed so that the decrease in strength as a plate frame structure is prevented.

Each of the elastic members 229 is disposed to be in contact with the bottom frame 221 at a position that is displaced to the rear frame 225 side which is the downstream side in the feeding direction of sheets P.

In addition, the rear frame 225 has a thick thickness in a plate thickness direction as a plate member, compared to the front frame 224, so that the rear frame 225 has a high rigidity.

Therefore, the decrease in strength as a plate frame structure that receives the impact force of the elastic members 229 is further prevented.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport apparatus comprising:

an accommodating tray configured to accommodated a recording medium and that is mounted to be capable of reciprocating with respect to a body;

a loading plate that is provided in the accommodating tray to be movable up and down and that is configured to be loaded with the recording medium;

a lift comprising a drum, wherein the lift is configured to:

move up the loading plate to a position where the recording medium is able to be fed by winding wires around the drum, wherein the wires are connected to opposite end portions of the loading plate to suspend the loading plate, and move down the loading plate by unwinding the wires from the drum; and a receiving frame that is provided on a bottom surface of the accommodating tray and that is configured to receive abutments provided on the loading plate when the loading plate moves down, wherein the accommodating tray has a higher-rigidity portion whose rigidity is higher at a downstream side in a feeding direction of the recording medium than that at an upstream side in the feeding direction of the recording medium.

2. The transport apparatus according to claim 1, wherein the receiving frame is fastened to opposite side walls of the accommodating tray using fastening members, and the receiving frame is configured to receive one of the abutments provided on the loading plate within a triangle region defined by connecting a plurality of fastening points where the receiving frame is fastened.

3. The transport apparatus according to claim 2, wherein the accommodating tray is made of a synthetic resin.

4. The transport apparatus according to claim 2, wherein the accommodating tray is made of a synthetic resin.

5. The transport apparatus according to claim 1, wherein the receiving frame is configured to receive one of the abutments provided on the loading plate, at a position displaced to a downstream side in a feeding direction of the recording medium.

6. The transport apparatus according to claim 5, wherein the accommodating tray is made of a synthetic resin.

7. The transport apparatus according to claim 1, wherein the rigidity of the higher-rigidity portion is enhanced as a thickness of the higher-rigidity portion at the downstream side in the accommodating tray is thicker than that of the higher-rigidity portion at the upstream side in the accommodating tray.

8. The transport apparatus according to claim 7, wherein the accommodating tray is made of a synthetic resin.

9. The transport apparatus according to claim 1, wherein the receiving frame is placed on protrusions formed on opposite side walls of the accommodating tray and is fastened to the opposite side walls using fastening members.

10. The transport apparatus according to claim 9, wherein the accommodating tray is made of a synthetic resin.

11. The transport apparatus according to claim 1, wherein a flat surface of the receiving frame is abutted against opposite side walls of the accommodating tray, and the receiving frame is fastened to the opposite side walls of the accommodating tray using fastening members.

12. The transport apparatus according to claim 11, wherein the accommodating tray is made of a synthetic resin.

13. The transport apparatus according to claim 1, wherein opposite side walls of the accommodating tray are placed on the receiving frame, and the receiving frame is fastened to the opposite side walls of the accommodating tray using fastening members.

14. The transport apparatus according to claim 13, wherein the accommodating tray is made of a synthetic resin.

15. The transport apparatus according to claim 1, wherein the accommodating tray is made of a synthetic resin.

16. A transport apparatus comprising:

an accommodating tray configured to accommodate a recording medium and that is mounted to be capable of reciprocating with respect to a body;

a loading plate that is provided in the accommodating tray to be movable up and down and that is configured to be loaded with the recording medium;

a lift comprising a drum, wherein the lift is configured to:

move up the loading plate to a position where the recording medium is able to be fed by winding wires around the drum, wherein the wires are connected to opposite end portions of the loading plate to suspend the loading plate, and move down the loading plate by unwinding the wires from the drum; and a receiving frame that is provided on a bottom surface of the accommodating tray and that is configured to receive abutments provided on the loading plate when the loading plate moves down, wherein projection portions of the receiving frame are fitted to recess portions of opposite side walls of the accommodating tray, and wherein the receiving frame is fastened to the opposite side walls of the accommodating tray using fastening members.

17. The transport apparatus according to claim 16, wherein the accommodating tray is made of a synthetic resin.

18. A transport apparatus comprising:

an accommodating tray configured to accommodate a recording medium and that is mounted to be capable of reciprocating with respect to a body;

a loading plate that is provided in the accommodating tray to be movable up and down and that is configured to be loaded with the recording medium;

a lift comprising a drum, wherein the lift is configured to:

move up the loading plate to a position where the recording medium is able to be fed by winding wires around the drum, wherein the wires are connected to opposite end portions of the loading plate to suspend the loading plate, and move down the loading plate by unwinding the wires from the drum; and a receiving frame that is provided on a bottom surface of the accommodating tray and that is configured to receive abutments provided on the loading plate when the loading plate moves down, wherein a thickness of a portion of the accommodating tray at a downstream side in a feeding direction of the recording medium is thicker than that of a portion of the accommodating tray at an upstream side in the feeding direction of the recording medium.

* * * * *